US008152397B2

(12) United States Patent
Gutberlet

(10) Patent No.: US 8,152,397 B2
(45) Date of Patent: Apr. 10, 2012

(54) PRODUCT REPLACEMENT UNIT FOR A BASE STICK MODULE IN PARTICULAR OF A COSMETIC STICK AS WELL AS A SET COMPRISING A PRODUCT REPLACEMENT UNIT OF THIS TYPE AND A PLURALITY OF BASE STICK MODULES

(75) Inventor: Detlev Gutberlet, Altdorf (DE)

(73) Assignee: H & M Gutberlet GmbH, Nuremberg (DE)

( * ) Notice: Subject to any disclaimer, the term of this patent is extended or adjusted under 35 U.S.C. 154(b) by 868 days.

(21) Appl. No.: 12/184,759

(22) Filed: Aug. 1, 2008

(65) Prior Publication Data

US 2009/0035049 A1 Feb. 5, 2009

(30) Foreign Application Priority Data

Aug. 1, 2007 (DE) ..... 20 2007 010 681 U

(51) Int. Cl.

| | |
|---|---|
| ***A45D 40/04*** | (2006.01) |
| ***A45D 40/06*** | (2006.01) |
| ***B43K 5/06*** | (2006.01) |
| ***B43K 21/08*** | (2006.01) |

(52) U.S. Cl. ..... 401/68; 401/172; 401/174; 401/263; 401/265; 401/66

(58) Field of Classification Search ..... 401/55, 401/65–68, 82, 83, 172, 174, 263, 265
See application file for complete search history.

(56) References Cited

U.S. PATENT DOCUMENTS

| | | | | |
|---|---|---|---|---|
| 5,011,317 | A * | 4/1991 | Gueret | 401/66 |
| 7,192,212 | B2 | 3/2007 | Gutberlet et al. | |
| 7,503,717 | B2 * | 3/2009 | Gutberlet | 401/66 |

FOREIGN PATENT DOCUMENTS

| | | | |
|---|---|---|---|
| DE | 9218502 | U1 | 9/1994 |
| DE | 19513239 | C1 | 3/1996 |
| DE | 9117141 | U1 | 4/1996 |
| DE | 20302008 | U1 | 4/2003 |
| EP | 0714638 | B1 | 6/1996 |

* cited by examiner

*Primary Examiner* — Tuan Nguyen
(74) *Attorney, Agent, or Firm* — Browdy and Neimark, PLLC

(57) ABSTRACT

A product replacement unit for a base stick module in particular of a cosmetic stick comprises a replacement housing with a reservoir in which a product, in particular a cosmetic product, is present in creamy, liquid or pasty form. An applicator is in a fluid connection with the reservoir, and a piston is guided for displacement in the replacement housing for feeding the product to the applicator. A piston connecting component is present on the piston for cooperating with a push rod connecting component of a piston push rod forming part of a feed device of the base stick module for extending the piston, wherein the piston push rod is formed to establish a push connection with the piston and is formed to be positioned on the side of the piston remote from the product.

9 Claims, 4 Drawing Sheets

PRODUCT REPLACEMENT UNIT FOR A BASE STICK MODULE IN PARTICULAR OF A COSMETIC STICK AS WELL AS A SET COMPRISING A PRODUCT REPLACEMENT UNIT OF THIS TYPE AND A PLURALITY OF BASE STICK MODULES

BACKGROUND OF THE INVENTION

1. Field of the Invention

The invention relates to a product replacement unit for a base stick module of a cosmetic stick. The invention also relates to a set comprising a product replacement unit of this type and a plurality of base stick modules.

2. Background Art

A product replacement unit of this type in the form of a cosmetic product replacement unit is known through prior public use. As soon as the cosmetic product is used up or is not intended to be used any further, the known replacement unit is used as a replacement for a corresponding stick unit, the replacement unit, together with the base stick module, reproducing the complete cosmetic stick. The replacement units known in the art are expensive to produce.

SUMMARY OF THE INVENTION

It is therefore an object of the present invention to develop a product replacement unit of the type mentioned at the outset such that the production costs for said replacement unit are reduced.

The object is achieved according to the invention by a product replacement unit for a base stick module, in particular of a cosmetic stick, with a replacement housing with a reservoir in which a product, in particular a cosmetic product, is present in creamy, liquid or pasty form, an applicator which is in a fluid connection with the reservoir, a piston which is guided for displacement in the replacement housing for feeding the product to the applicator, and a piston connecting component which is present on the piston for cooperating with a push rod connecting component of a piston push rod as part of a feed device of the base stick module for extending the piston, wherein the piston push rod is formed to establish a push connection with the piston and is formed to be positioned on the side of the piston remote from the product.

According to the invention, it has been found that it is unnecessary to install mechanical operational components of the feed device of the stick, in particular of the cosmetic stick, in the replacement unit. These operational components of the feed device are omitted in the inventive replacement unit and are fully installed in the base stick module. As a result, a simply constructed replacement unit is obtained which may accordingly be produced in a cost-effective manner. The replacement units may be filled, stored and sold separately from the base stick modules. The base stick modules may be completed to produce the complete cosmetic sticks when they reach the customer or immediately before dispatch. The use of the replacement units allows the feed devices to be configured as high-quality mechanisms which may be sold at a suitable price. Mechanisms of this type may be produced, for example, from anodized aluminum. The high-quality mechanisms may be used repeatedly in that new replacement units are reused in each case to replace used-up stick units and are connected to the feed device of the base stick module. It is also possible to provide the replacement units with different products, in particular also with different applicators or different dimensions, for example with different application surfaces or different piston diameters or different reservoir sizes. Therefore, when consumers purchase only a single base stick module, they are able to choose between various cosmetic products, for example various colors and also various reservoir sizes and application techniques, without each time purchasing a completely new base stick module for this purpose. The inventive replacement unit may be used for cosmetic sticks but also for writing utensils or medical dosing devices. The product, in particular the cosmetic product may also be a gel-like product. Due to the fact that the piston push rod is formed to be positioned on the side of the piston remote from the product, it is ensured that apart from the piston, no other part of the piston displacement mechanism comes into contact with the product. This is a particular advantage compared to displacement mechanisms based on spindles penetrating the piston.

A design of the replacement housing wherein the reservoir is formed in one piece with a base body of the replacement housing provides for easy assembly of the replacement unit.

A sealing cap which tightly seals the replacement housing on the side of the applicator to store the replacement unit prevents the product from drying up during storage of the replacement unit.

A closure cap which seals the replacement housing on the side of the piston to store the replacement unit protects the piston of the replacement unit.

The closure cap may also be designed such as to tightly seal the replacement unit.

A push rod connecting component which is a blind recess in the piston into which penetrates a free end of the piston push rod is designed in a simple manner while taking into account that a push-rod connection usually suffices for advancing the cosmetic product. It is therefore not necessary to retract the piston via the piston push rod.

Another object of the invention is to provide for an even more extensive use of the advantages of a replacement unit without complex feed device components.

This object is achieved according to the invention by a set comprising an inventive product replacement unit and a plurality of base stick modules which have feed devices for the product, the feed devices differing from one another in their mechanical operating principles.

According to the invention, it has been found that for a replacement unit which no longer has operational components of a feed device for advancing the piston, it is possible to freely select the type and manner of mechanical construction of these operational components of the feed device. The replacement unit may therefore be used with base stick modules of different mechanical operating principles. The single requirement is to provide compatibility in the connection between the replacement unit and the base stick module.

Mechanisms of the base stick module which are either configured as a pressure mechanism such that a pressure exerted on an actuating element results in an incremental advance of the piston in the reservoir or as a rotation mechanism such that a rotation of an actuating element results in a continuous advance of the piston in the reservoir proved to be suitable when a free-flowing product is used.

An embodiment of the invention will be described in more detail in the following with reference to the drawings

DESCRIPTION OF THE PREFERRED EMBODIMENTS

Figure 1:
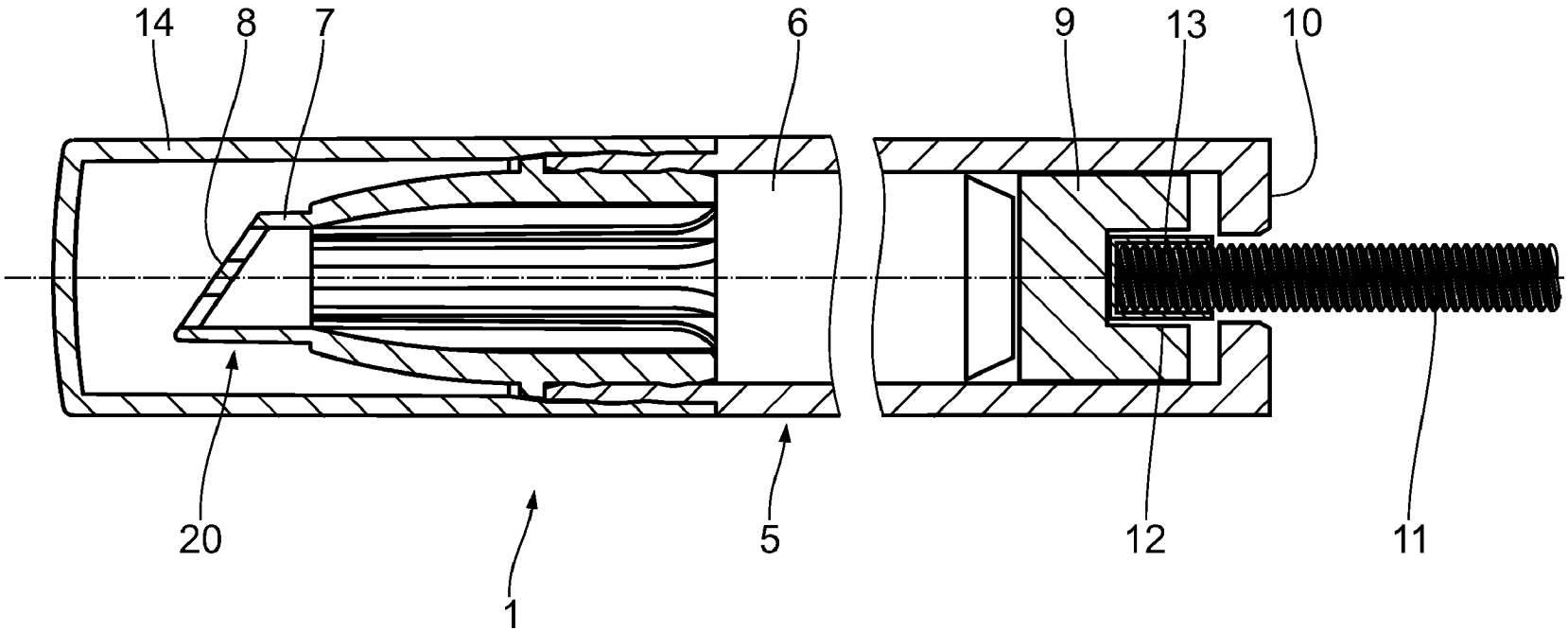
FIG. 1 shows a side view of a cosmetic product replacement for a base stick module of a cosmetic stick, the cosmetic product replacement being broken open so as to show inner details thereof.
Figure 2:
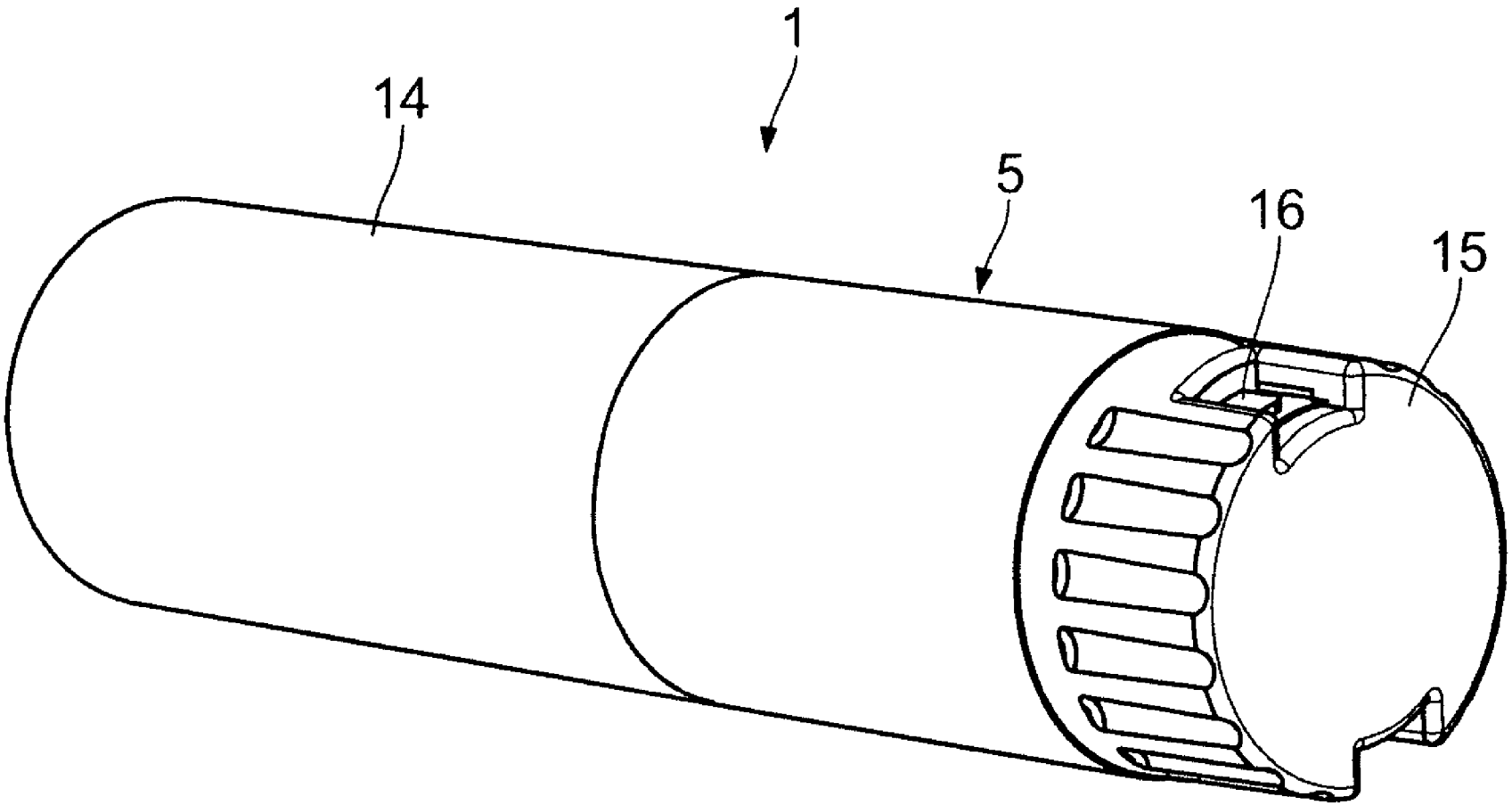
FIG. 2 shows a perspective view of the cosmetic product replacement unit with the closure cap attached.
Figure 3:
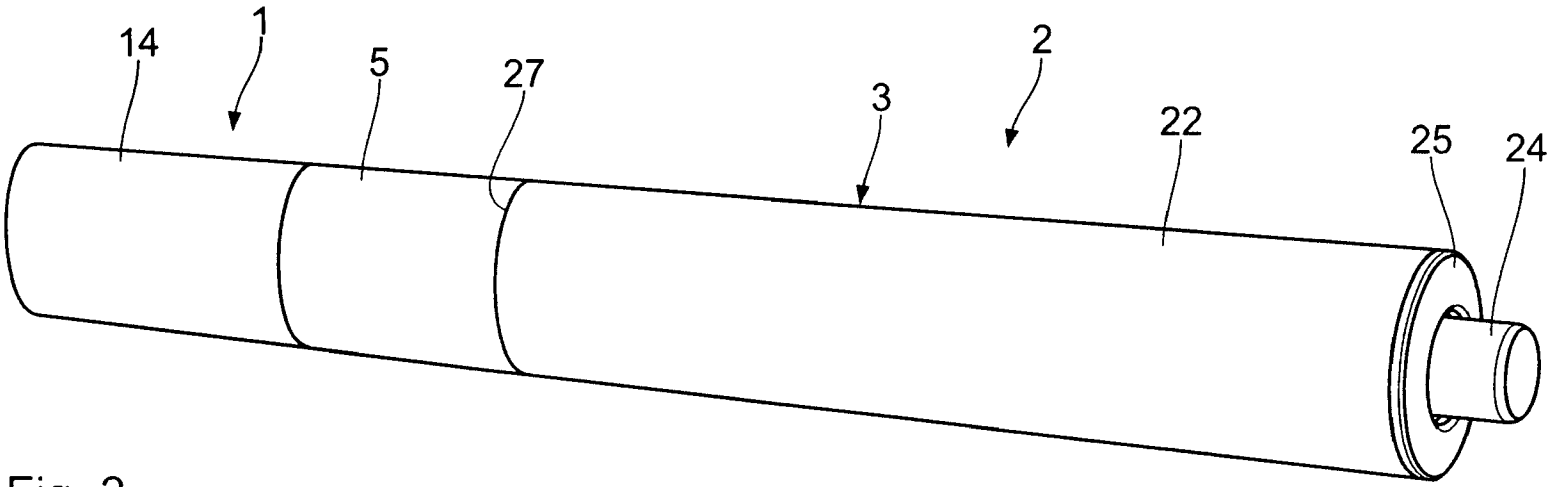
FIG. 3 shows a perspective view of the cosmetic stick comprising the cosmetic product replacement unit and a first embodiment of the base stick module.
Figure 4:
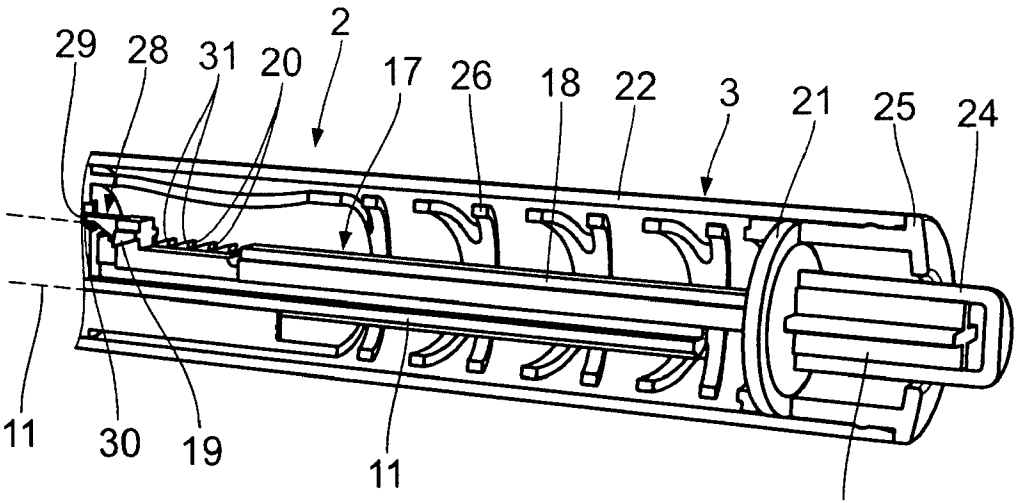
FIG. 4 shows a broken longitudinal section through the cosmetic stick according to FIG. 3 in the vicinity of the base stick module comprising a pressure mechanism.

FIGS. 1 and 2 show a product replacement unit 1 for a base stick module of a cosmetic stick. Examples of such base stick modules which may be combined with the product replacement unit 1 to produce a complete cosmetic stick 2 are shown in FIGS. 3 and 4 (base stick module 3) and in FIGS. 5 and 6 (base stick module 4).

The product replacement unit 1 has a replacement housing 5 comprising a reservoir 6 which contains a creamy, liquid, pasty or gel-like cosmetic product. The reservoir 6 may have a round, an oval or even a polygonal cross-section. The reservoir 6 is made of a translucent plastics or glass material and is formed in one piece with a base body of the replacement housing 5 so that the reservoir 6 forms a translucent housing wall of the replacement housing 5, thus ensuring an easy level control of the cosmetic product in the replacement housing 5 by visual inspection from outside.

An applicator 7 is in a fluid connection with the reservoir 6, the applicator 7 being attached to the reservoir 6. The applicator 7 is a flocked applicator 7 having a beveled application surface 8. An unflocked design of the applicator is conceivable as well. For example, applicator types may generally be used which are disclosed in DE 203 02 008 U1.

A piston 9 is disposed in the replacement housing 5, the piston 9 being guided for displacement in the reservoir 6. The edge of the piston 9 seals against the inner wall of the reservoir 6. When the piston 9 of FIG. 1 is displaced towards the top of the reservoir 6, this causes the cosmetic product to be pressed out of the reservoir and into the applicator 7, thus escaping the applicator 7 via the application surface 8 for application of the cosmetic product.

In a position of maximum retraction in the reservoir 6 shown in FIG. 1, the piston 9 is secured by a stop collar 10 of the replacement housing 5. Likewise, an anti-rotation device may be provided, preventing a rotational movement of the piston 9 in the reservoir 6. This anti-rotation device is not shown in FIG. 1.

For axial displacement of the piston 9 in the reservoir 6, the piston 9 cooperates with a piston push rod 11 which is a threaded rod in FIG. 1. The piston 9 is connected with the piston push rod 11 via a piston connecting component which is a blind recess 12 that is penetrated by a free end 13 of the piston rod 11, wherein the free end 13 may be covered if necessary. The piston rod 11 does not form part of the product replacement unit 1 but of the base stick module 3 or 4.

A sealing cap 14 tightly seals the replacement housing 5 on the side of the applicator 7 when the cosmetic stick 2 comprising the product replacement unit 1 is not used.

FIG. 2 shows the product replacement unit 1 with an attached closure cap 15 which closes the replacement housing 5 on the side of the piston 9 to store the replacement unit 1. To this end, the closure cap 15 is latched with latch members 16 of the replacement housing 5 which are not visible in the schematic representation of FIG. 1.

The following is a description of a pressure mechanism of the base stick module 3 with reference to FIGS. 3 and 4, with FIG. 3 showing the entire cosmetic stick 2 comprising the base stick module 3, the latter being completed by the replacement unit 1 to produce the complete cosmetic stick 2. The free end 13 of the piston push rod 11 is just outside the visible drawing area of FIG. 4.

A feed device 17 of the base stick module 3 for advancing the piston push rod 11 includes an actuating push rod 18. The latter is in a push connection with the piston push rod 11. Said push connection is produced via a pair of stops comprising a first stop 19 positioned on the actuating push rod 18 and a plurality of second stops 20 positioned in succession at an equal distance from one another axially along the piston push rod 11. Overall, there are two rows of second stops 20 at the same height between which runs the actuating push rod 18. In the feed position shown in FIG. 4, the first stop 19 of the actuating push rod 18 cooperates with the second stop 20 arranged furthest to the left as shown in FIG. 4 so that the piston is in the starting position shown in FIG. 1, with the piston 12 being fully retracted down to the stop collar 10.

Where the actuating push rod 18 runs between the two rows of second stops 20 up to the free end of the piston push rod 11, the two push rods 11, 18 are guided towards one another so that a defined relative movement of the two push rods 11, 18 with respect to one another is possible. This guidance is carried out by a complementary cross-sectional configuration of adjacent portions of the push rods 11, 18. This guide means is a T groove guide.

On its side remote from the piston 9, the actuating push rod 18 has a contact circumferential collar 21. The outer diameter of the contact circumferential collar 21 corresponds to the inner diameter of a base housing 22 of the base stick module 3. A free end 23, adjacent to the contact circumferential collar 21, of the actuating push rod 18 bears an operating button 24 as actuating element which is latched with the free end 23. Like an operating button for a ballpoint pen, the operating button 24 protrudes out of the end, opposite the replacement unit 1, of the base housing 22. A stopper 25 is latched into a housing opening of the base housing 22 from which the operating button 24 protrudes, the stopper 25 being shaped like a sleeve and penetrated by the operating button 24. An inner front wall of the stopper 25 rests against the contact circumferential collar 21 of the actuating push rod 18. A plastic pretensioning spring 26 rests against the contact circumferential collar 21 on the side opposite the stopper 25. At its opposite free end, the plastic pretensioning spring 26 is supported against an inwardly projecting circumferential collar of the base housing 22. Not shown in the drawing, this circumferential collar is closely adjacent to a dividing line 27 between the base housing 22 and the replacement housing 5.

A stop alternating device 28 is a component of the feed device 17. To advance the piston 9, the stop alternating device 28 alternates the first stop 19 between one of the second stops 20 with which the first stop 19 momentarily cooperates and which is also called the second momentary stop, and an axially adjacent further second stop 20 which is also called the target stop. The stop alternating device 28 has a driver body 29 formed on the free end, facing the piston 9, of the actuating push rod 18. The driver body 29 supports the two first stops 19 on both sides like wing stumps, the two first stops 19 being positioned at the same height.

A ramp 30 cooperates with the driver body 29. Said ramp 30 is formed in an intermediate base of the plastic pretensioning spring 26 which in turn is secured to the base housing 22 at this position. The ramp 30 is therefore secured to the base housing 22.

The second stops 20 positioned axially in succession at an equal distance from one another are configured in the manner of saw teeth. The flanks of this saw tooth configuration, each of which is steep and vertical in practice, form the second stops 20. Oblique wall portions 31 run between these vertical wall portions. The incline of these oblique wall portions 31 with respect to a longitudinal axis of the base housing 22 is sufficiently low for the wing stumps of the driver body 29 to be able to slide on the oblique wall portions 31 in a direction opposite to the feed direction, without the piston push rod 11 being axially displaced relative to the base housing 22 as a result.

When the operating button 24 is actuated, in other words when the operating button 24 is pushed into the base housing 22, the piston push rod 11 is advanced by the actuating push rod 18 by way of the engagement of the first stop 19 with the second momentary stop 20, initially by a distance of advancement which at least equals the axial distance between two second stops 20. After this distance of advancement, the driver body 29 has run onto the ramp 30 to such an extent that the first stop 19 disengages from the second momentary stop 20. Further advancement of the piston push rod 11 therefore does not take place, irrespective of whether the operating button 24 is pressed further into the base housing 22. When the operating button 24 is released, it is pushed back again into the rest position shown in FIG. 4 due to the pretension of the plastic pretensioning spring 26 until the circumferential collar 21 rests against the stopper 25.

During this pushing back action, the driver body 29 slides on the oblique wall portions 31 of the piston slide rod 11. In doing so, the piston slide rod 11 is not displaced axially relative to the base housing 22 so that in the rest position of the operating button 24, the first stop 19 is then able to engage the second target stop 20 which is axially adjacent to the previous second momentary stop 20, more specifically is axially adjacent on the right-hand side in FIG. 4. The base stick module 3 thus comprises a pressure mechanism, similar to the mechanism of a mechanical pencil, with an incremental advance effect for the piston 9. A pressure exerted on the operating button 24 results in an incremental advance of the piston 9 in the reservoir 6 that corresponds to the distance between two adjacent second stops 20.

Figure 5:
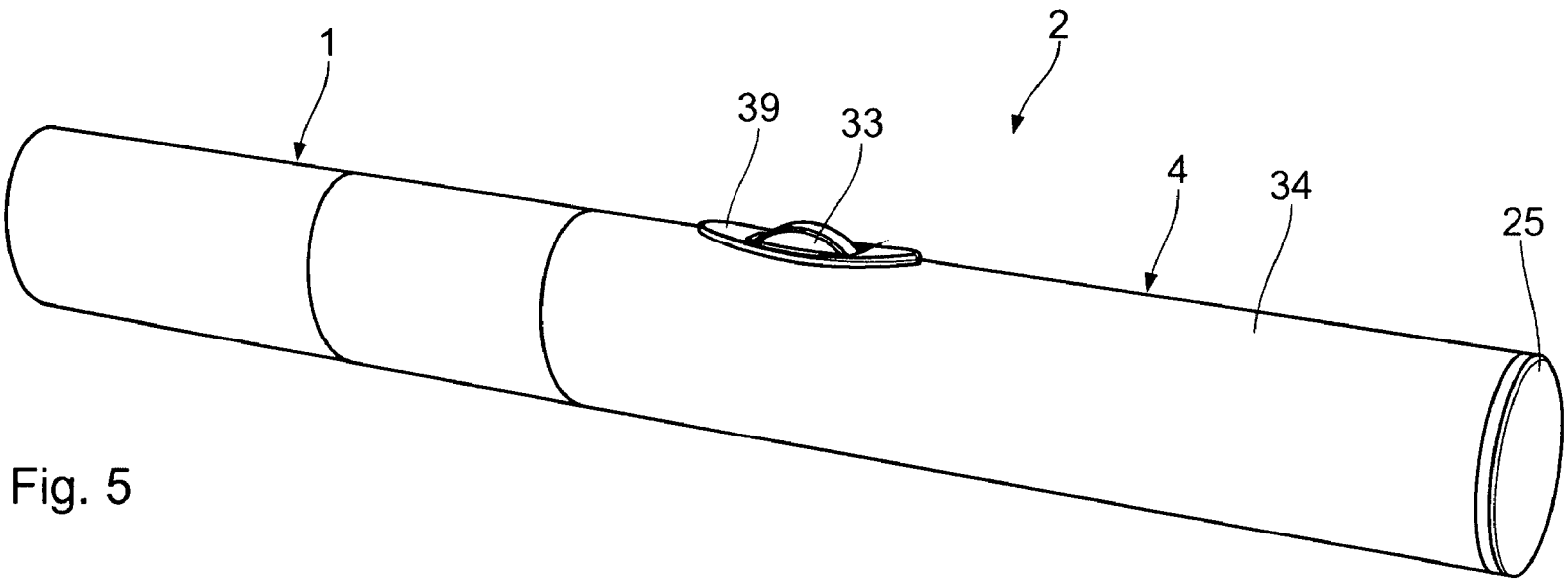
FIG. 5 shows a perspective view of the cosmetic stick comprising the cosmetic product replacement unit and another embodiment of the base stick module.
Figure 6:
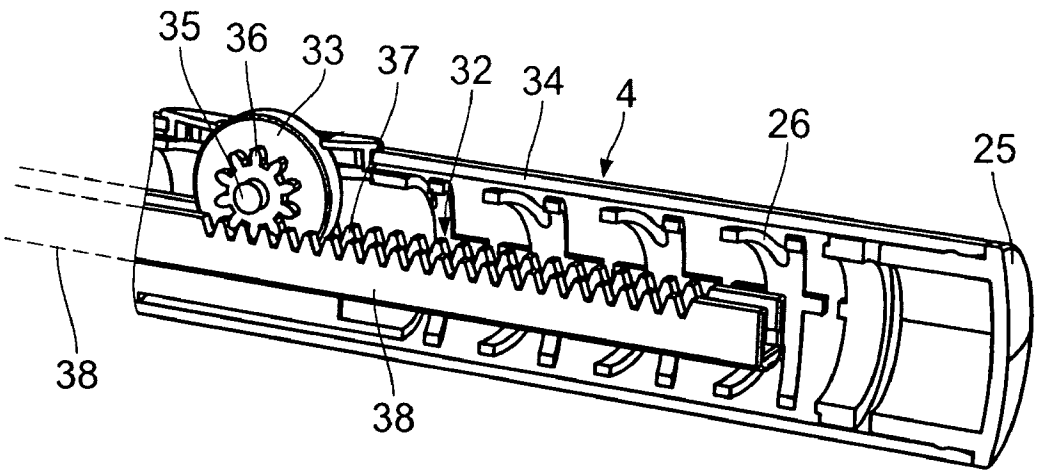
FIG. 6 shows a broken longitudinal section through the cosmetic stick according to FIG. 3 in the vicinity of the base stick module having a rotation mechanism.

FIGS. 5 and 6 show the base stick module 4 comprising a rotation mechanism for advance of the piston 9, with FIG. 5 showing the entire cosmetic stick 2 comprising the base stick module 4, wherein the latter is completed by the replacement unit 1 to produce the complete cosmetic stick 2. Components which are equivalent to those described above with reference to FIGS. 1 to 4 have been given the same reference numerals and are not described again.

The base stick module 4 of the cosmetic stick 2 according to FIGS. 5 and 6 has a feed device 32 with an actuating wheel 33. A portion of the circumference of the actuating wheel 33 protrudes out of a base housing 34 of the base stick module 4. Gear wheels 36 are formed on the actuating wheel 33 on each of the axle journals 35 guided out of the actuating wheel 33 on both sides thereof. The gear wheels 36 mesh with two rack portions 37 of a piston push rod 38 of the base stick module 4, the rack portions 37 running parallel to each other. The end of the rack portions 37 facing the replacement unit 1 is the free end 13 (cf. FIG. 1).

The axle journals 35 of the actuating wheel 33 are latched into latch recesses of a screen housing portion 39. The screen housing portion 39 which surrounds the actuating wheel 33 is again latched into a recess of the base housing 34.

A rotation of the actuating wheel 33 causes the piston push rod 38 to be pushed out together with the piston 9 which is in push connection with the piston push rod 38. A rotation of the actuating wheel 33 results in a continuous advance of the piston 9 in the reservoir 6.

In the embodiment according to FIGS. 5 and 6, the stopper 25 has no through-opening since this embodiment has no penetrating operating button.

Alternatively, the actuating wheel 33 may also be a double wheel and have a single gear wheel, cooperating with a single rack portion 37 of a corresponding piston push rod, between the two wheel portions of the double wheel, the wheel portions being axially spaced from one another and connected in a non-rotating manner. A comparable actuating double wheel comprising two wheel portions is disclosed in EP 0 714 638 B1 where it is used in an application device for dental material.

Another rotation mechanism which may be used in another embodiment of a base stick module is for example disclosed in DE 203 03 008 U1. A difference lies in that the piston push rod is not rigidly connected to the piston as it is the case in DE 203 03 008 U1 but via a connection comprising a blind recess corresponding to that described above with respect to FIG. 1.

What is claimed is:

1. A product replacement unit (1) configured to be removably connected to a base stick module (3; 4) such that the replacement unit (1) may be filled stored and sold separately from the base stick module (3; 4), the product replacement unit (1) comprising a replacement housing (5) with a reservoir (6) in which a product is present in one of the forms comprising creamy, liquid or pasty products, an applicator (7) which is in a fluid connection with the reservoir (6), a piston (9) which is guided for displacement in the replacement housing (5) for feeding the product to the applicator (7), a piston connecting component (12) which is present on the piston (9) for cooperating with a push rod connecting component (13) of a piston push rod (11), the piston push rod (11) formed as part of a feed device (17; 32) of the base stick module (3; 4) for extending the piston (9), wherein the piston push rod (11) is formed to establish a push connection with the piston (9) and is formed to be positioned on the side of the piston (9) remote from the product, and a closure cap (15) which seals the replacement housing (5) on the side of the piston (9) to store the replacement unit (1), wherein the replacement housing (5) comprises latch members (16) with which the closure cap (15) is latched.

2. A product replacement unit according to claim 1, in which the base stick module (3; 4) belongs to a cosmetic stick (2).

3. A product replacement unit according to claim 1, in which the product contained in the reservoir (6) of the replacement housing (5) is a cosmetic product.

4. A replacement unit according to claim 1, wherein the reservoir (6) is formed in one piece with a base body of the replacement housing (5).

5. A replacement unit according to claim 1, comprising a sealing cap (14) which tightly seals the replacement housing (5) on the side of the applicator (7) to store the replacement unit (1).

6. A replacement unit according to claim 1, wherein the push rod connecting component is a blind recess (12) in the piston (9) into which penetrates a free end (13) of the piston push rod (11).

7. A set comprising a product replacement unit (1) according to one of claim 1 and a plurality of base stick modules (3, 4) which have feed devices (17, 32) for the product (9), the feed devices (17, 32) differing from one another in their mechanical operating principles.

8. A set according to claim 7, wherein the feed device (17) of one of the base stick modules (3, 4) is a pressure mechanism so that a pressure exerted on an actuating element (24) results in an incremental advance of the piston (9) in the reservoir (6).

9. A set according to claim 7, wherein the feed device (32) of one of the base stick modules (3, 4) is a rotation mechanism so that a rotation of an actuating element (33) results in a continuous advance of the piston (9) in the reservoir (6).

* * * * *